United States Patent [19]

Grimsley et al.

[11] Patent Number: 4,863,564

[45] Date of Patent: Sep. 5, 1989

[54] METHOD OF BLEACHING HIGH YIELD PULP BY USING DITHIONITE ION AND EXCLUDING OXYGEN

[75] Inventors: S. Allen Grimsley, Portsmouth; James C. Robinson, Chesapeake; Mark A. Schroeder, Norfolk, all of Va.

[73] Assignee: Virginia Chemicals Inc., Portsmouth, Va.

[21] Appl. No.: 136,975

[22] Filed: Dec. 23, 1987

[51] Int. Cl.[4] ..... D21C 9/10

[52] U.S. Cl. ..... 162/53; 162/71; 162/83; 162/205; 162/207; 162/339

[58] Field of Search ..... 162/83, 339, 340, 380, 162/358, 290, 53, 71, 52, 205, 207, 204, 212, 258, 202

[56] References Cited

U.S. PATENT DOCUMENTS 3,467,574 9/1969 West ..... 162/26

4,063,997 12/1977 Kirjavainen et al. ..... 162/340

FOREIGN PATENT DOCUMENTS 2477595 9/1981 France ..... 162/380

OTHER PUBLICATIONS

Westvaco, "Panorama of Papermaking Today", 1971.

Singh, "The Bleaching of Pulp", TAPPI Press, Atlanta; 1979, pp. 255–259.

Fleury et al., "Characterization of Chromophoric Groups in Groundwood and Lignin Model Compounds by Reaction with Specie Reducing Agents"; Pulp & Paper Canada, Mar. 15, 1968, pp. 62–68.

*Primary Examiner*—Steve Alvo

*Attorney, Agent, or Firm*—Depaoli & O'Brien

[57] ABSTRACT

A method is described for increasing the brightness of reductively bleached high yield pulps, comprising bleaching the pulps with a reductive bleaching solution under anaerobic conditions and maintaining the bleached pulps under anaerobic conditions during all handling steps subsequent to bleaching, including paper formation, wet pressing, and drying of the paper formed therefrom. The bleached paper has higher brightness than the same paper produced under aerobic conditions, and the bleaching and handling-derived portion of this higher brightness is retained after storage of the finished paper.

6 Claims, No Drawings

METHOD OF BLEACHING HIGH YIELD PULP BY USING DITHIONITE ION AND EXCLUDING OXYGEN

BACKGROUND OF THE INVENTION

1. Field of the Invention

This invention relates to bleaching and especially to bleaching of high yield pulps with dithionite-based compositions. More particularly, it relates to handling pulps that have been reductively bleached with dithionite to obtain higher post-reversion brightness.

2. Review of the Prior Art

High yield wood pulps comprise groundwood pulps, either stone ground or refiner ground, and semi-chemical pulps. The former are respectively ground between stones or patterned steel discs without chemicals, and the latter are briefly softened by pressure cooking with chemicals before refiner grinding. These pulps are preferred for temporary usages requiring low strength, such as newsprint.

Groundwood pulps from certain woods, such as spruce, are sufficiently bright for such uses without bleaching, but others need to be increased in brightness, particularly if semi-chemically cooked. Dithionites, often termed hydrosulfites, are highly suitable for the purpose as a reductive bleaching or brightening agent. Zinc dithionite has been used for years, but it has been largely replaced by sodium dithionite because of ecological requirements.

By using a dithionite, the brightness of mechanically disintegrated woodpulp, which is normally in the neighborhood of about 60% versus an MgO standard, can be increased significantly, but reversion always occurs during handling of the bleached pulp so that the permanent increase in brightness is generally in the neighborhood of about 10 points or less.

U.S. Pat. No. 2,707,144 describe bleaching of mechanically disintegrated woodpulp with a water soluble dithionite in combination with a water soluble polyphosphate by mixing the dithionite and polyphosphate with the woodpulp at a temperature of 120°–212° F. and a pH of 3–8.5 while the consistency of the pulp is about 2–5%. As two examples, brightness increases of 4 points and 7.7 points for dithionite alone are given. The solution of bleaching material is intimately mixed with the pulp, and the mixture is then forced as a continuously moving stream, preferably characterized by streamlined plug flow, along a confined, air-tight path so that the flowing mixture of pulp and bleaching materials substantially fills the cross-section of the confined path and continues to flow in the closed circuit formed by this path until the desired bleaching is obtained.

U.S. Pat. No. 2,826,478 of Schucker teaches that bleaching of groundwood may be effected in or immediately following the grinding pit by mixing hydrosulfite and citrate and/or tetraborate under quiescent or relatively quiescent conditions and in confinement to minimize the possibility of entrainment of air.

In a paper presented at the annual meeting of the technical section, Canadian Pulp and Paper Association on Jan. 23–26, 1968, Fleury and Rapson presented data on reducing chromophoric groups in groundwood, without disrupting the macromolecular system of the wood, by use of uranium-III, chromium-II, dithionite, and borohydride as bleaching agents. They demonstrated that reduction with the dithionite anion increased its brightness, under any conditions of time, temperature, pH, or quantity of reducing agent, no more than 10 points under an inert gas atmosphere such as carbon dioxide or nitrogen since the oxygen in the air destroys the reducing chemicals, such as dithionite. Experimental reductions were made with uranium and chromium as cationic reducing agents, both at pH=1, and with dithionite and borohydride as anionic reducing agents, at respective pH conditions of 5.5 and 10.5. All reductions were carried out with the same equipment and always under an inert gas atmosphere such as carbon dioxide or nitrogen because the oxygen in the air destroys the reducing chemicals. An exemplary reduction with uranium-III was described, using 1.25 electron-equivalents. A carbon dioxide atmosphere was maintained during the bleaching operation at 60° C. and during cooling to 20° C. After filtering and thorough rinsing with water to remove most of the uranium, carbon dioxide was again used during suspension in an aqueous solution of 0.2N Na2 EDTA and heating at 85–95° C. for 15 minutes and then during a repetition of this washing operation.

Hand sheets were made from the reduced groundwood and dried as quickly as possible under vacuum while excluding oxygen. Reflectance measurements were made against magnesium oxide as a 100% reflectance standard and evaluated over the range of 300–600 mu. The brightness gain of 20 points for the uranium-III bleaching was not permanent. After storage of the hand sheets at room temperature, the brightness dropped to about 16 points above the original pulp brightness within a few days.

U.S. Pat. No. 3,467,574 describes a process of bleaching lignin cellulose material with a reducing bleaching agent which utilizes multi-stage refiners. In the first refiner, the temperature of the material is increased to facilitate out-gassing of oxygen-containing vapors which are deleterious to reductive bleaching. Alternatively, the system may be maintained under a pressure less than atmospheric, so that lower temperatures are necessary to effect out-gassing, or inert gasses may be employed to minimize oxidation. After partial defiberizing in the first refiner at a temperature of about 70°212° F. and a consistency of 15–50%, the pulp is further refined in a second refiner stage and then conveyed along an enclosed passageway to a third refiner stage, with a reductive bleaching agent, such as zinc dithionite, being added thereto as it is fed to this stage.

The bleached pulp is discharged from the bleaching refiner into a sump from which air is substantially excluded while the consistency of the pulp is reduced to about 4–5%. The pulp is retained in the sump for about 20 minutes to fully develop maximum brightness.

The paper industry is presently requiring ever higher brightness standards, and dithionite reductive bleaching is having difficulty meeting these higher standards which are in competition with oxidative bleaching processes.

SUMMARY OF THE INVENTION

It is the object of this invention to provide a reductive bleaching process, using dithionite ion, to provide a higher final paper brightness than is presently possible under aerobic conditions.

In accordance with this objective, this invention comprises the exclusion of air from reductively bleached pulp during all handling steps subsequent to bleaching and before completion of the paper drying step. It has surprisingly been found that: (1) bleaching under anaerobic conditions and subsequently handling the bleached pulp under anaerobic conditions thereafter, until paper formation, wet pressing, and drying have been substantially completed, produce a significantly higher paper brightness and (2) the anaerobic bleaching and handling-derived portion of this higher brightness is retained after storage of the finished paper.

Since final brightness is higher under these stated conditions when compared with air drying, as is present industry practice, reductive bleaching can give higher brightness than is presently possible, thus allowing competition with oxidative bleaching markets wherein higher brightness is required.

In a pulp and paper mill, exclusion of air from a high yield pulp being bleached requires use of heat, vacuum, or an inert gas. Because it is time consuming to heat and then to cool a large mass of stock at storage consistency, it is preferable to adjust consistency of the bleached pulp with de-aerated water which has been boiled or heated under vacuum. A high-consistency storage tank can be filled with an inert gas before the pulp and water are delivered thereto.

After storage, the bleached stock can be further diluted with de-aerated water before delivery to the head box which should be filled with an inert gas, such as $CO_2N_2$, dry steam, or combustion gases (mixed $N_2$, $C_2$). The wire should also be blanketed with a thin layer of flowing inert gas. In addition, the press section of the paper machine should be within an enclosure filled with an inert gas under slight positive pressure.

By excluding air and any other gas containing molecular oxygen from a high yield pulp during bleaching and through all handling steps to production of paper, the higher brightness that is achieved by air-excluded bleaching is retained in the finished paper. When reversion occurs, it is at a conventional rate, and the additional brightness created by air exclusion is retained.

DESCRIPTION OF THE PREFERRED EMBODIMENTS

The process of this invention can be utilized in any groundwood or semi-chemical mill in which the pulp is brightened or bleached with dithionite. It is only necessary to fit each bleaching tank and tower with a cover if not already available, to add piping, to install inert gas supply and delivery systems, to build an enclosing hood for the press section of each paper machine, and the like. Spruce and fir TMP pulps are more readily protected from oxidation by vacuum drying or anaerobic drying than are pine, Southern pine, or hemlock. Nevertheless, the beneficial result for any such pulp is that the paper which is produced can have a residual brightness which is significantly higher than that of the same pulp conventionally bleached with dithionite ion but without exclusion of air.

EXAMPLES

The usefulness of air exclusion during bleaching and post-bleach handling of high yield pulps was demonstrated in the laboratory, as shown in the following handsheet examples:

Example 1

A spruce/fir thermomechanical pulp (TMP) was bleached at 60° C. for 60 minutes with five amounts, measured on an oven-dried pulp basis, of V-Brite B Blend® (a proprietary compound containing sodium dithionite, produced by Virginia Chemicals Inc.). Handsheets were then prepared from the unbleached pulp and from each of the five bleached pulps under five conditions: (a) in air, followed by air drying of the handsheets; (b) in air, followed by vacuum drying of the handsheets; (c) in an inert atmosphere for all steps of handsheet making, followed by vacuum drying of the handsheets; (d) in air, followed by air drying (in a dessicator); and (e) in air, followed by oxygen drying (in a dessicator). Brightness values were measured on all handsheets, with the following results:

| | Spruce/Fir TMP | | | | |
|---|---|---|---|---|---|
| | Brightness | | | | |
| V-Brit ® B Blend(%)[1] | Air-Dried | Vacuum-Dried | Air-less[2] | Dessi-cator[3] | $O_2$/Dessi-cator[4] |
| 0 | 56.3 | — | — | — | — |
| 0.3 | 62.3 | 68.1 | — | — | — |
| 0.5 | 65.1 | 68.9 | — | — | — |
| 0.7 | 65.9 | 68.7 | 69.8 | — | — |
| 1.0 | 66.6 | 70.4 | — | 67.5 | 66.4 |
| 1.5 | 66.8 | 71.7 | 72.2 | — | — |

[1]% on an oven-dried pulp basis.
[2]Inert atmosphere ($N_2$ or $CO_2$) provided for all steps of handsheet making. Handsheets were vacuum-dried.
[3]Dried in a dessicator (air atmosphere).
[4]Dried in a dessicator (oxygen atmosphere).

The effect of vacuum drying of spruce/fir TMP handsheets was to increase brightness by 3–6 points so that a higher brightness could be obtained with somewhat less than 0.3% V-Brite® B after vacuum drying than with 1.5% V-Br Brite® B after air drying. Anaerobic drying produced slightly better results.

Example 2

A pine/hemlock TMP was similarly bleached with three amounts, on an oven-dried pulp basis, of the same V-Brite® B Blend. Handsheets were then prepared from unbleached pulp and from each of the three bleached pulps, followed by air drying or vacuum drying of the handsheets. Brightness values were measured on all handsheets, with the following results:

| | Pine/Hemlock TMP | | |
|---|---|---|---|
| | Brightness | | |
| V-Brite ® B Blend(%)* | Air-Dried | Vacuum-Dried | Gain |
| 0 | 53.2 | 54.3 | 1.1 |
| 0.3 | 58.4 | 61.1 | 3.2 |
| 0.7 | 59.7 | 62.9 | 3.2 |
| 1.5 | 60.8 | 64.1 | 3.3 |

*% on an oven-dried pulp basis.

The effect of vacuum drying of pine/hemlock TMP handsheets was to increase brightness by more than 3 points so that a higher brightness could be obtained with 0.3% V-Brite® B after vacuum drying than with 1.5% V-Brite® B after air drying.

Example 3

A Southern pine TMP was bleached with 1.0% V-Brite® B under the same conditions as in Examples 1 and 2. Handsheets were then prepared from the unbleached and bleached pulps. The bleached handsheets were air-dried, vacuum dried, or anaerobically dried as follows:

| | Southern Pine TMP | | |
|---|---|---|---|
| | Brightness | | |
| V-Brite ® B Blend(%)* | Air-Dried | Vacuum-Dried | Dried Under $N_2$ |
| 0 | 55.9 | — | — |
| 1.0 | 64.9 | 66.4 | 66.1 |

*% on an oven-dried pulp basis.

The effect of vacuum drying was to increase brightness by 1.5 points, and the effect of drying under nitrogen was to increase brightness by 1.2 points.

It can be concluded that the bleached chromophores in spruce and fir TMP are more easily oxidized than the bleached chromophores in pine and hemlock and in Southern pine, whereby protecting spruce and fir TMP from oxidation by vacuum drying or anaerobic drying is more beneficial than protecting pine, Southern pine, or hemlock from similar oxidation, although TMP's from these three species are also improved when protected from oxidation.

What is claimed is:

1. A method for improving the final brightness of a reductively bleached high yield pulp by using dithionite ion, comprising:

A. excluding gases containing molecular oxygen, during said reductive bleaching of said pulp, to provide a bleached pulp having significatly higher brightness;

B. excluding said gases and dissolved oxygen from said bleached pulp during storage, transfer, and dilution of said pulp subsequent to said bleaching;

C. excluding said dissolved oxygen from said bleached pulp after said storage by use of de-aerated water during said dilution of said bleached pulp;

D. excluding said gases from contact with said bleached pulp during formation of a wet paper sheet;

E. substantially excluding said gases from contact with said wet sheet during wet pressing thereof; and F. substantially excluding said gases from contact with said pressed sheet during drying thereof.

2. The method of claim 1, wherein said storage comprises storage at high consistency.

3. The method of claim 1, wherein said dilution comprises diluting said pulp to a desired consistency with de-aerated water for feeding to the head box of a paper machine.

4. The method of claim 1, wherein said excluding of siad gases and said dissolved oxygen comprises the use of vacuum.

5. The method of claim 1, wherein said excluding of said gases comprises the admission of an inert gas.

6. The method of claim 5, wherein said inert gas is selected from the group consisting of $CO_2$, $N_2$, dry steam, and combustion gases containing a mixture of $N_2$ and $CO_2$.

* * * * *